US011404769B2

(12) United States Patent
Notari et al.

(10) Patent No.: US 11,404,769 B2
(45) Date of Patent: Aug. 2, 2022

(54) ANTENNA MODULE FOR A VEHICLE WITH RADIANT ELEMENTS ARRANGEMENT

(71) Applicant: ASK INDUSTRIES SOCIETA' PER AZIONI, Monte San Vito (IT)

(72) Inventors: Andrea Notari, Viano (IT); Matteo Cerretelli, Sesto Fiorentino (IT); Gianluca La Cono, Reggio Emilia (IT); Paolo Facchini, Reggio Emilia (IT); Massimo Roncaglia, Formigine (IT); Gianluca Camellini, Reggio Emilia (IT)

( * ) Notice: Subject to any disclaimer, the term of this patent is extended or adjusted under 35 U.S.C. 154(b) by 0 days.

(21) Appl. No.: 17/319,332

(22) Filed: May 13, 2021

(65) Prior Publication Data

US 2021/0359398 A1 Nov. 18, 2021

(30) Foreign Application Priority Data

May 14, 2020 (IT) ..... 102020000011089

(51) Int. Cl.
*H01Q 1/32* (2006.01)
*H01Q 1/42* (2006.01)

(52) U.S. Cl.
CPC ..... *H01Q 1/3275* (2013.01); *H01Q 1/42* (2013.01)

(58) Field of Classification Search
CPC ..... H01Q 1/32; H01Q 1/3275; H01Q 1/42; H01Q 1/521; H01Q 21/28
See application file for complete search history.

(56) References Cited

U.S. PATENT DOCUMENTS

2013/0082890 A1 4/2013 Wang et al.
2018/0109006 A1 4/2018 Ng et al.

FOREIGN PATENT DOCUMENTS

| | | | | |
|---|---|---|---|---|
| CN | 204885432 U | | 12/2015 | |
| CN | 106099322 A | | 11/2016 | |
| CN | 107181047 A | | 9/2017 | |
| CN | 210838086 U | * | 6/2020 | ..... H01Q 1/325 |
| EP | 2622682 B1 | | 7/2015 | |
| WO | 2017076750 A1 | | 5/2017 | |

OTHER PUBLICATIONS

Search Report for priority Italian Application No. 102020000011089, dated Feb. 3, 2021.

* cited by examiner

*Primary Examiner* — Hoang V Nguyen
(74) *Attorney, Agent, or Firm* — Egbert, McDaniel & Swartz, PLLC

(57) ABSTRACT

Antenna module for a vehicle including a base suitable for being fixed to a vehicle body, a main board disposed horizontally on the base, a first, second, third and fourth radiant element that protrude in upper position from the main board. The first and the second radiant element have median axes that extend in the direction of the vertical axis and intersect the horizontal plane of the base in intersection points disposed on both sides with respect to the longitudinal axis of the base and spaced by distances from the longitudinal axis of the base. The third and fourth radiant elements have median axes that extend in the direction of the vertical axis and intersect the horizontal plane of the base in intersection points disposed on both sides with respect to the longitudinal axis of the base and spaced by distances from the longitudinal axis of the base.

13 Claims, 11 Drawing Sheets

ANTENNA MODULE FOR A VEHICLE WITH RADIANT ELEMENTS ARRANGEMENT

CROSS-REFERENCE TO RELATED APPLICATIONS

Not applicable.

BACKGROUND OF THE INVENTION

1. Field of the Invention

The present invention relates to an antenna module for a vehicle with a particular arrangement of radiant elements, in such a way to implement different functions of the antenna, in a reduced space and without affecting the aerodynamic characteristics of the vehicle.

2. Description of Related Art Including Information Disclosed Under 37 CFR 1.97 and 37 CFR 1.98

In the automotive sector antennas are generally disposed on the roof of the vehicle. Antennas are known, wherein the components are disposed in an aerodynamic box that is shaped like a shark fin in order to reduce air friction.

However, in addition to the function of radio receiver at AM and FM frequencies, antennas have been recently provided with additional functions, such as transceivers of signals for mobile telephony and GPS signals and digital radio. Consequently, the antenna module requires the addition of components that consist of radiant elements that cannot be contained in a shark fin-shaped box with standardized dimensions. Moreover, if they are disposed too close to each other, the radiant elements generate interference due to signal coupling.

CN107181047 discloses a vehicle antenna comprising: a first radiant element made with a double spiral on a PCB and a second radiant element with capacitive loading elements. The second radiant element has a triangular shape, is disposed orthogonally to the first radiant element and is provided with a cut wherein a third radiant element is inserted. The radiant elements are aligned with respect to a central longitudinal axis of the antenna. The intersection between the radiant elements and their alignment causes the coupling of signals between the various radiant elements.

CN106099322A discloses an antenna comprising three radiant elements consisting of a first PCB for AM/FM, a second PCB for high-frequency DAB, and a third PCB for low-frequency DAB. The various PCBs and components of the antenna are aligned and arranged symmetrically with respect to a central longitudinal axis of the antenna. The geometric distribution, wherein various radiant elements are arranged in a line along the longitudinal axis typically tends to make one direction of radiation prevail over the other or, in the worst case, to create real nulls of radiation in certain directions due to the shielding derived from the proximal radiant elements.

CN204885432 discloses an antenna assembly with a plurality of independent radiant elements. All radiant elements are aligned with respect to the longitudinal axis of the antenna. Only one radiant element extends along the transverse axis of the antenna, it being in any case centered and symmetrical with respect to the longitudinal axis of the antenna, resulting in the aforementioned drawbacks.

EP2622682A1 discloses a multi-function antenna composed of multiple radiant elements: two patch antennas for GNSS and SDARS functions and two antennas for LTE and AM-FM functions obtained by means of PCBs disposed in vertical position. The AM-FM antenna is realized in a distributed manner on three vertical PCBs: a central PCB arranged along the longitudinal axis, and two end PCBs arranged transversely and engaged at the ends of the central PCB. The assembly of the three PCBs recreates a comprehensive antenna structure by means of the realization of conductive tracks on each PCB, together with a grid of conductors disposed between the two end PCBs. The two end PCBs also perform an inductive loading function for the antenna. Such an antenna is impaired by some drawbacks because the distributed AM/FM antenna is bulky and complex to make. Moreover, the radiant element with vertical LTE PCB is perfectly parallel and very close to one of the end PCBs of the distributed AM-FM antenna, generating a low level of uncoupling between the LTE antenna and the AM-FM antenna.

WO2017076750 discloses an antenna unit comprising a main PCB disposed in horizontal position that acts as a base, two LTE antennas consisting of PCB, two Wi-Fi antennas composed of monopoles and two patch antennas. The base has a rectangular, non-elongated shape, with a ratio of minor side to major side of approximately 7/11. Due to the shape of the base, the antennas can be disposed at a sufficient distance in order to avoid interference. In fact, the two LTE antennas are disposed near the edges of the minor sides of the base and are symmetrical with respect to a center line axis; the two Wi-Fi antennas are disposed near the edges of the major sides of the base, in offset position; and the two patch antennas are disposed in central positions of the base. A non-elongated parallelepiped cover is coupled with the base in order to cover the antennas. Obviously, such a cover is not aerodynamic when disposed on a roof of a vehicle.

US2018109006A1 discloses an antenna assembly comprising a main PCB disposed in horizontal position that acts as a base and a plurality of Wi-Fi, LTE, and patch antennas. The base has a circular shape. In this case, in order to avoid interference between antennas, the Wi-Fi and LTE antennas are disposed in peripheral position, proximal to the circular edge of the base, and the patch antenna is disposed in a central position of the base. A cover shaped like a segment of a sphere is coupled with the base in order to cover the antennas. Obviously, such a cover is not as aerodynamic as an elongated cover.

US2013082890A1 discloses an array antenna comprising a plurality of radiant elements (notch antenna) disposed according to intersection points of a grid, equally spaced from each other and cooperating in order to work as an antenna. In such a case, a control unit must be provided to control the power of the radiant elements, establishing the amplitude and the phase of the signals to be sent to each radiant element. This type of application is for highly directional antennas and cannot be used for omnidirectional antennas, such as vehicle antennas.

The purpose of the present invention is to eliminate the drawbacks of the prior art by disclosing an antenna module for a vehicle with an elongated aerodynamic shape, suitable for being disposed on a roof of a vehicle, and provided with a particular arrangement of radiant elements to optimize the volume and at the same time guarantee a suitable uncoupling between the radiant elements.

Another purpose of the present invention is to disclose such an antenna module for a vehicle that has different functions and at the same time has an elongated aerodynamic shape with reduced dimensions and is easy to realize and install.

BRIEF SUMMARY OF THE INVENTION

These purposes are achieved according to the invention with the characteristics of the independent claim 1.

Advantageous embodiments of the invention appear from the dependent claims.

The antenna module for a vehicle according to the invention is defined in claim 1.

The antenna module according to the invention comprises at least four radiant elements that are distributed in the space in a substantially transverse and longitudinal and/or oblique direction relative to an axis of the antenna module that extends in the major dimension of the antenna module, which coincides with the traveling direction of the vehicle. The radiant elements comprise a first pair of radiant elements that are offset on both sides with respect to the longitudinal axis and to the transverse axis of the antenna module, and a second pair of radiant element that are offset on both sides with respect to the longitudinal axis and to the transverse axis of the antenna module.

The radiant elements work as individual omnidirectional antennas.

In such a way, the mutual influence of the radiant elements and the radiation diagram of the individual elements can be optimized. In fact, by varying the misalignment of the radiant elements on the longitudinal axis and on the transverse axis of the antenna module, the distribution in azimuth of the maximums and of the minimums of radiation can be optimized in order to obtain a radiation diagram that is as isotropic (omnidirectional) as possible for every radiant element.

The invention provides for misaligning the radiant elements as much as possible in a controlled way, i.e. at least two radiant elements misaligned with respect to the longitudinal axis and to the transverse axis of the antenna module, in order to minimize or in any case optimize the mutual interactions that are inevitably present, also when the various radiant elements are dedicated to different functions and have different working frequencies.

The antenna module of the invention comprises a plurality of radiant elements, supporting multiple functions of vehicle antennas, such as the telephone function, which is typically used for voice and/or data connection, in version with single or double radiant element, as well as implementing other typical vehicle functions, such as AM, FM, DAB, V2X, Wi-Fi, Bluetooth, etc.

In the antenna module of the invention, in general, the radiant elements do not have a double spiral, do not intersect and do not touch each other. Instead, they have a single spiral or a non-spiral geometry. Moreover, each type of radiant element, regardless of being composed of a single PCB or a single metal plate, is an independent radiant element that works as an independent antenna, without cooperating with other radiant elements. Otherwise said, the radiant element is not part of a distributed structure, such as for example an array comprising a plurality of radiant elements that cooperate to perform an antenna function. Advantageously, the volume and the complexity are reduced for each function and the radiant elements can be disposed correctly in order to minimize coupling.

BRIEF DESCRIPTION OF THE SEVERAL VIEWS OF THE DRAWINGS

Additional features of the invention will be clearer from the following detailed description, which refers to a merely illustrative, not limiting embodiment, which is shown in the appended figures, wherein.

DETAILED DESCRIPTION OF THE INVENTION

Figure 1:
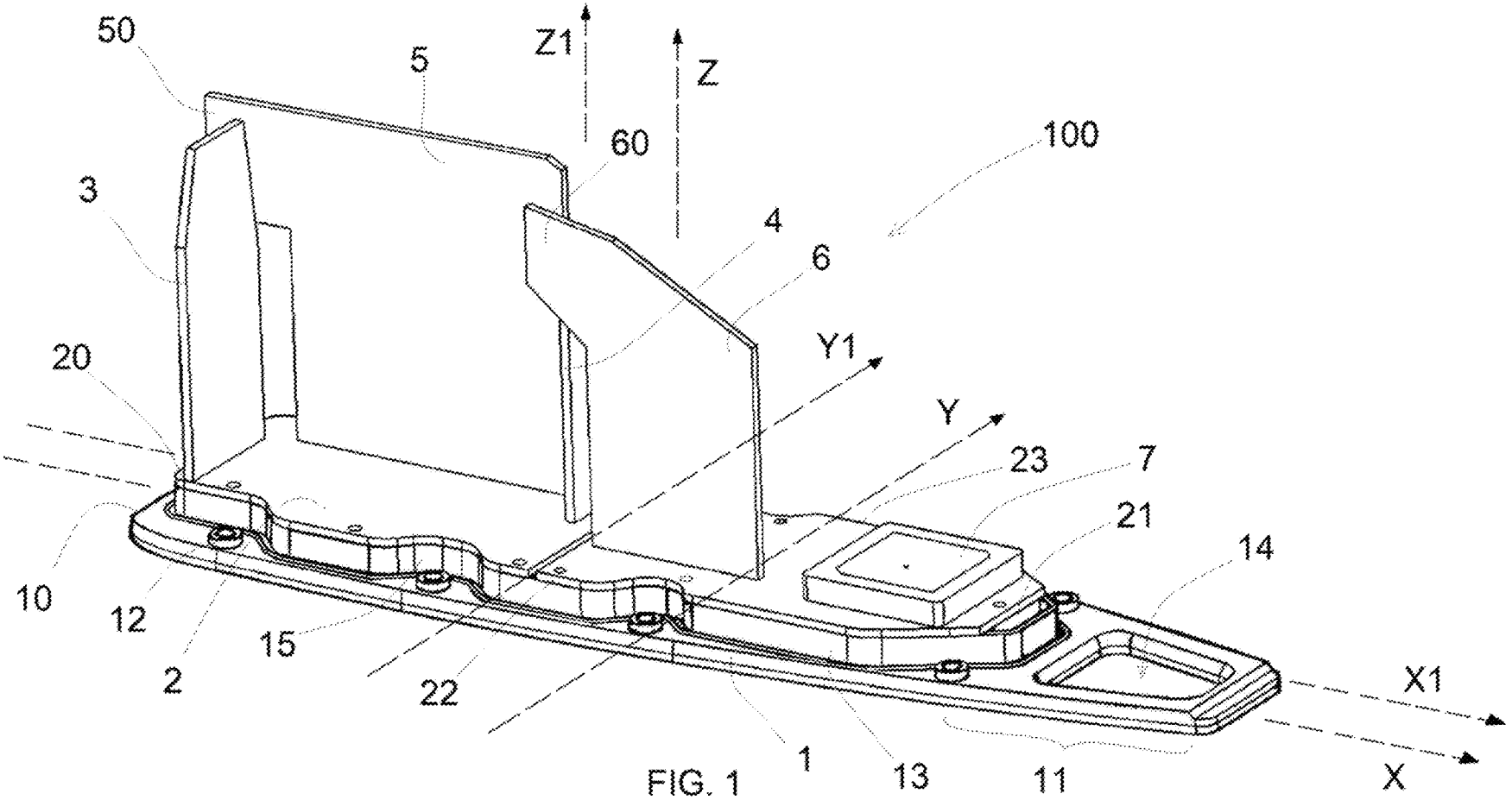
FIG. 1 is a perspective view of the antenna module according to the invention.

With reference to the Figures, the antenna module according to the invention is disclosed, which is generally indicated with reference numeral 100.

The antenna module (100) comprises a base (1) suitable for being fixed on a part of a vehicle body, such as for example a roof.

In the following description, the terms "front" and "rear" refer to the traveling direction of the vehicle, without prejudice for the fact that the antenna can be mounted on the vehicle in the opposite direction.

Figure 3:
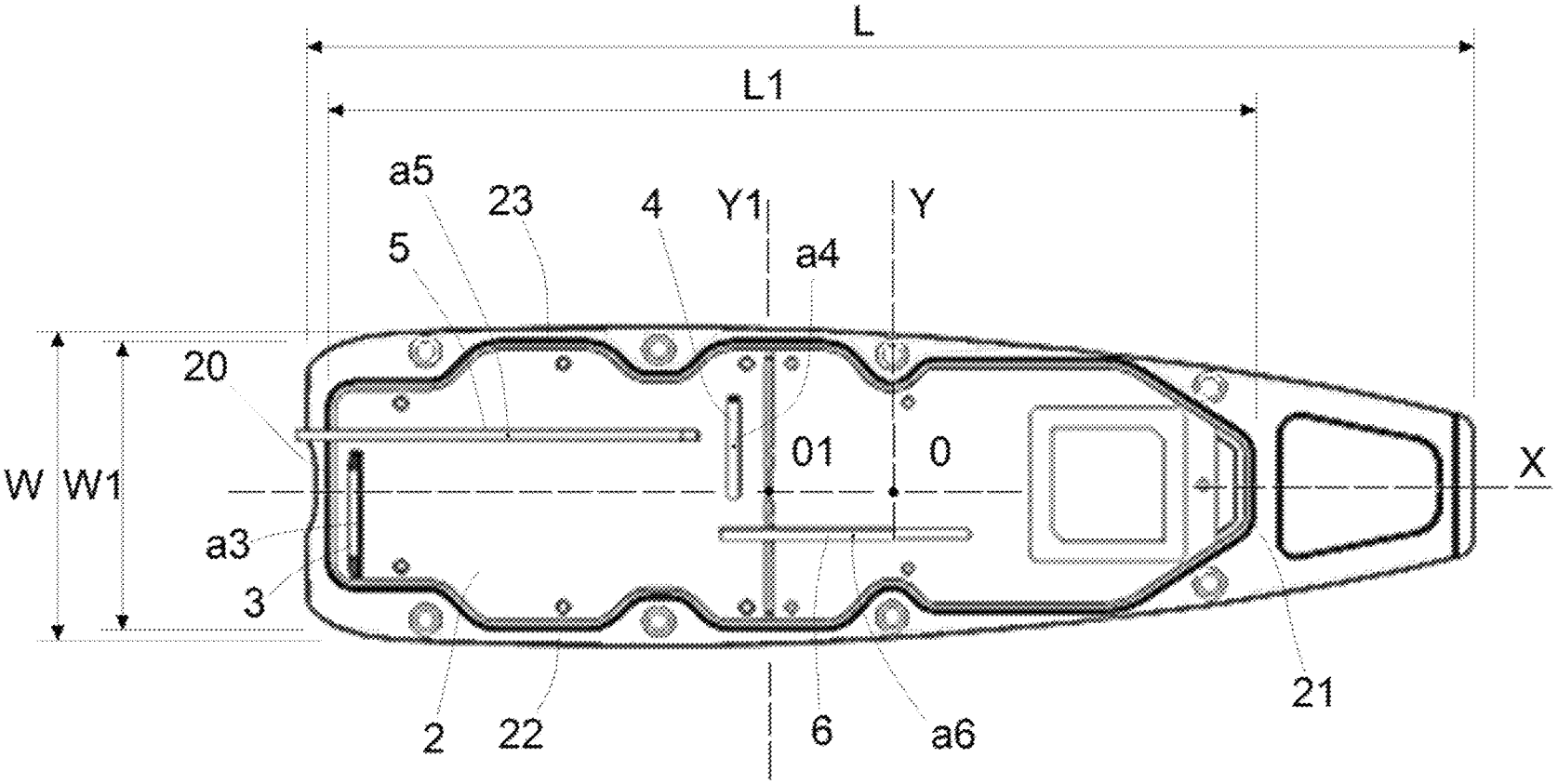
FIG. 3 is a top view of the antenna module of FIG. 1.

The base (1) is shaped like a rectangular or elongated plate, provided with a rear end (10) and a front end (11) with tapered shape with decreasing dimensions going towards the front. The base (1) has a longitudinal axis (X) and a transverse axis (Y) that intersect in a center (O) of the base (FIG. 3). The longitudinal axis and the transverse axis of the base coincide with the central longitudinal and transverse lines of the base. A vertical axis (Z) of the base can be defined, orthogonal to the plane formed by the axes X and Y of the base and passing through the center (O).

With reference to FIG. 3, the base (10) has a length (L) and a width (W), considered as maximum width, wherein the length (L) is more than three times the width (W).

Figure 10:
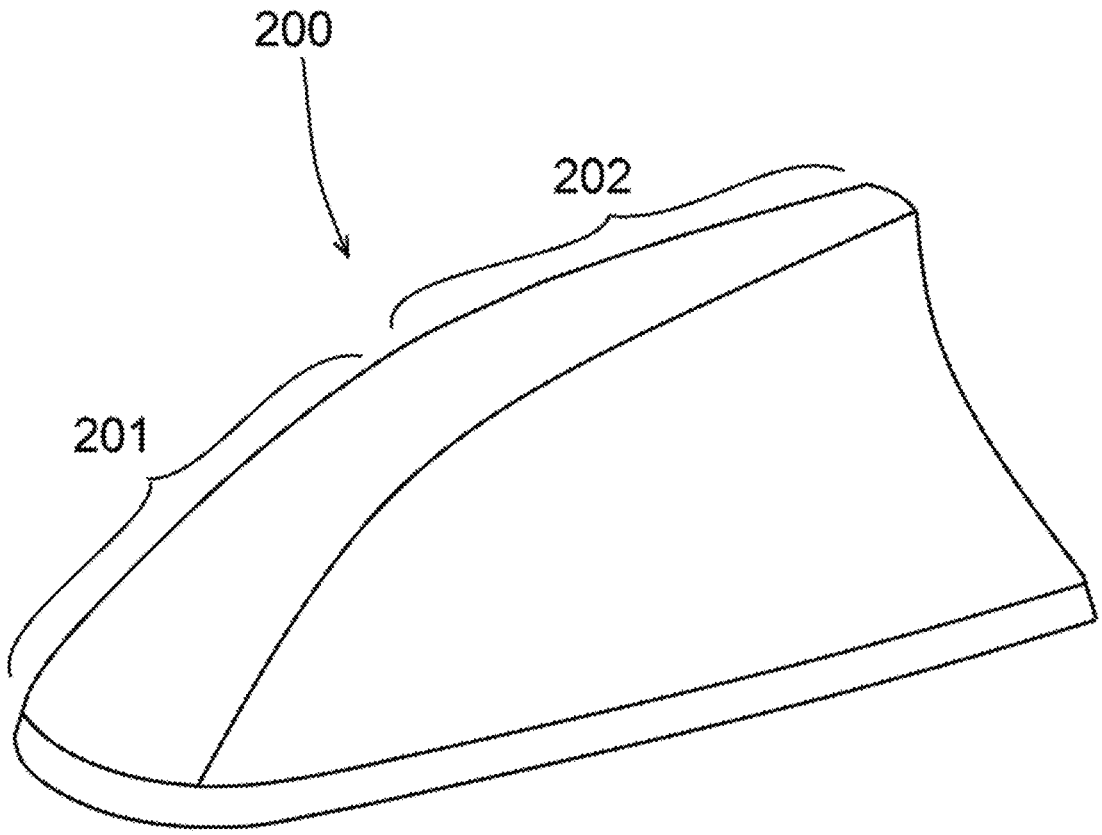
FIG. 10 is a perspective view of an example of cover of the antenna module according to the invention.

Shanks (12) protrude upwards from the base, near the lateral edges of the base (1). The shanks (12) are suitable for receiving fixing means, such as screws, for fixing a cover (200) (shown in FIG. 10), with an aerodynamic elongated shape like a shark fin. Such a cover (200) has a rear portion (201) with maximum height and a tapered front portion (202) with decreasing height going towards the front.

A raised support (13) protrudes upwards from the base (1) and extends from the rear end (10) to the front portion (11) of the base. The front portion (11) of the base is provided with a through slot (14) with trapezoidal shape.

The raised support (13) is shaped like a plate with a slightly higher thickness than the base (1). The raised support (13) has lateral edges with bends (15) around the shanks (12) in order to provide access to the shanks (12). The raised support (13) can be made in one piece with the base. Advantageously, the base (1) and the raised support (13) are made of a zinc, aluminum and magnesium alloy, which is known with the trade name ZAMA (ZAMAC or ZAMAK).

A main board (2) is disposed on the raised support (13). The main board (2) can be realized on one PCB or can be divided in multiple PCBs disposed along a horizontal plane parallel to the base (1). The main board (2) has a substantially rectangular shape provided with a rear end (20), a front end (21), a right lateral edge (21) and a left lateral edge (22).

With reference to FIG. 3, the main board (2) has a length (L1) that is lower than the length (L) of the base and a width (W1), considered as maximum width, that is lower than the width (W) of the base. In any case, the length (L1) of the main board (2) is twice and a half times higher than the width (W1) of the main board (2).

The main board (2) has a longitudinal axis (X1) and a transverse axis (Y1) that intersect in a center (O1) of the main board (FIG. 3). The longitudinal axis and the transverse axis of the main board coincide with the central longitudinal and transverse lines of the main board. Obviously, the center (O1) of the main board is disposed in rear position relative to the center (O) of the base.

A vertical axis (Z1) of the main board can be defined, orthogonal to the main board and passing through the center (O1) of the main board.

The antenna module (100) comprises a first pair of radiant elements comprising a first radiant element (3) and a second radiant element (4) that implement the functions of two separate independent antennas.

The first and the second radiant element (3, 4) are mounted on the main board (2). Each radiant element (3, 4) has a longitudinal dimension that is the dimension that extends along the vertical axis (Z). The radiant elements (3, 4) are disposed on the main board (2) in a substantially vertical position, protruding upwards from the main board along the longitudinal dimension of the radiant element.

Each radiant element (3, 4) can be a PCB or a conductive plate (FIGS. 7-9) with a suitable shape. In such a case, the radiant element (3, 4) has a substantially planar geometry.

FIG. 3 shows a configuration wherein the first and the second radiant element (3, 4) are disposed in transverse direction, i.e. the planes of the radiant elements are orthogonal to the longitudinal axis (X).

Figure 7:
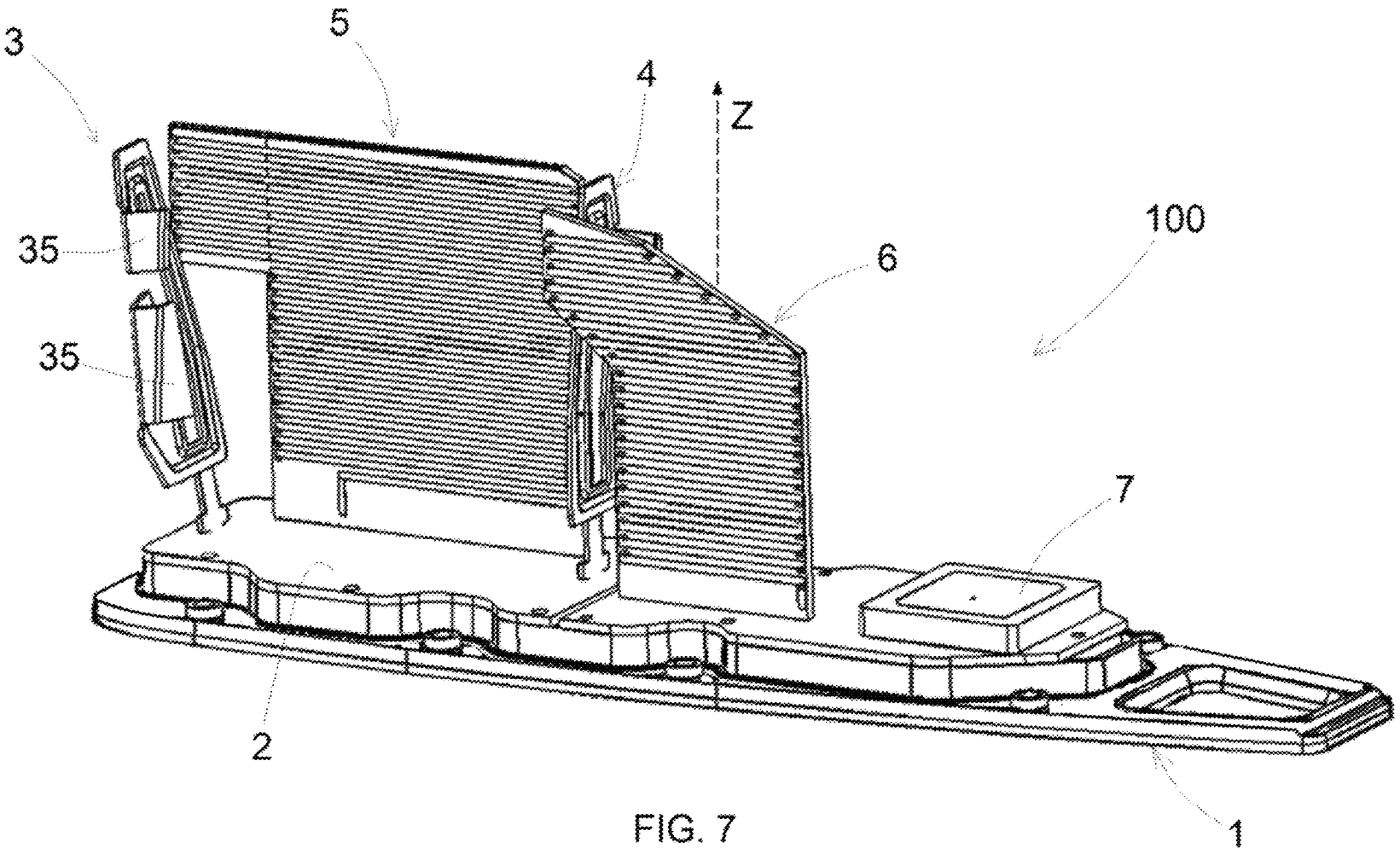
FIG. 7 is a perspective view of a second embodiment of the antenna module, wherein two radiant elements are conductive plates.

FIG. 7 shows a configuration wherein the first radiant element (3) is disposed in transverse direction and is inclined relative to the vertical axis (Z) of the base and the second radiant element (4) is disposed in transverse orthogonal direction relative to the base (1).

The first and the second radiant element (3, 4) have respective median axes (a3, a4). A median axis is a longitudinal axis passing through the center of the radiant element and passing through the base (1).

Figure 3A:
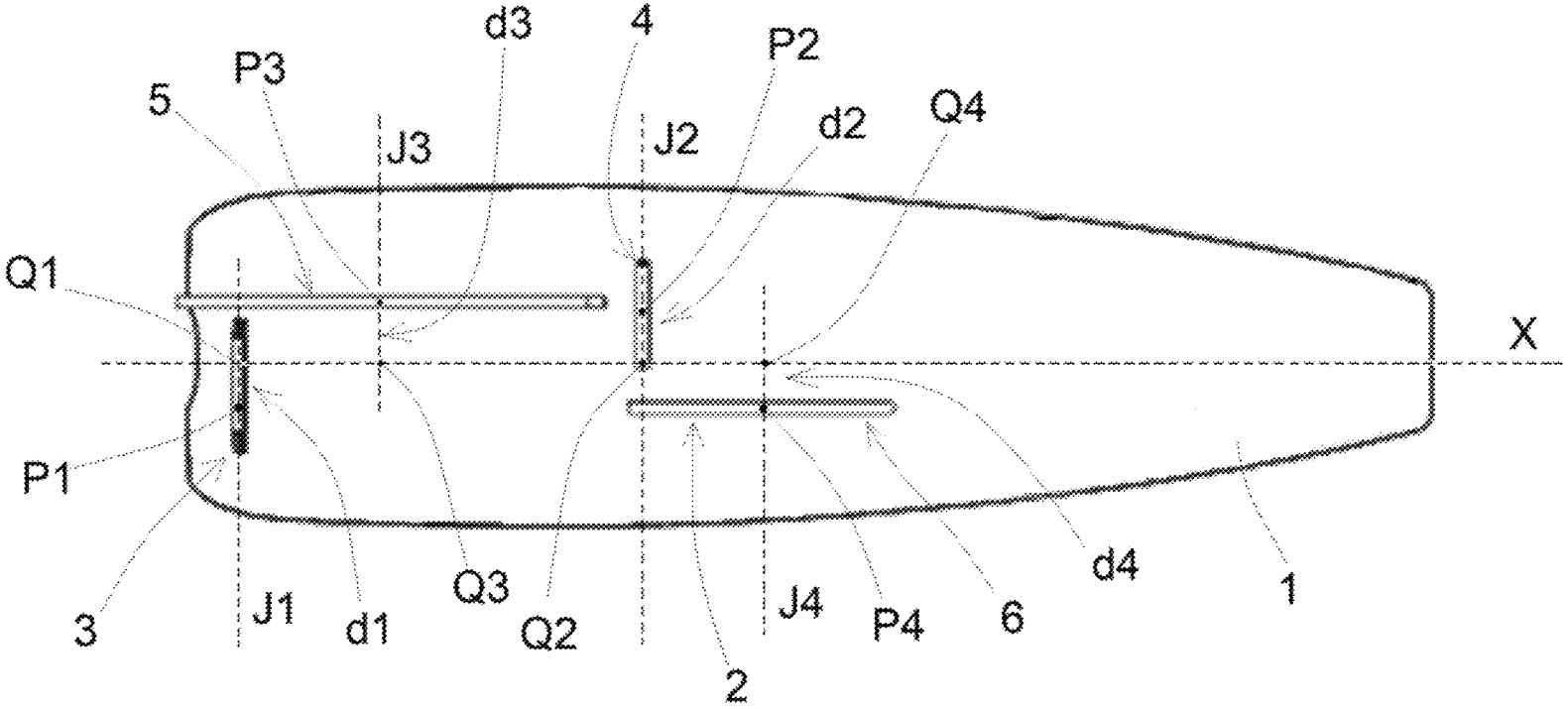
FIG. 3A is a diagrammatic view that shows the intersection points of the median axes of the radiant elements with a horizontal plane of the base, and the projections of said intersection points on the longitudinal axis of the base.
Figure 4:
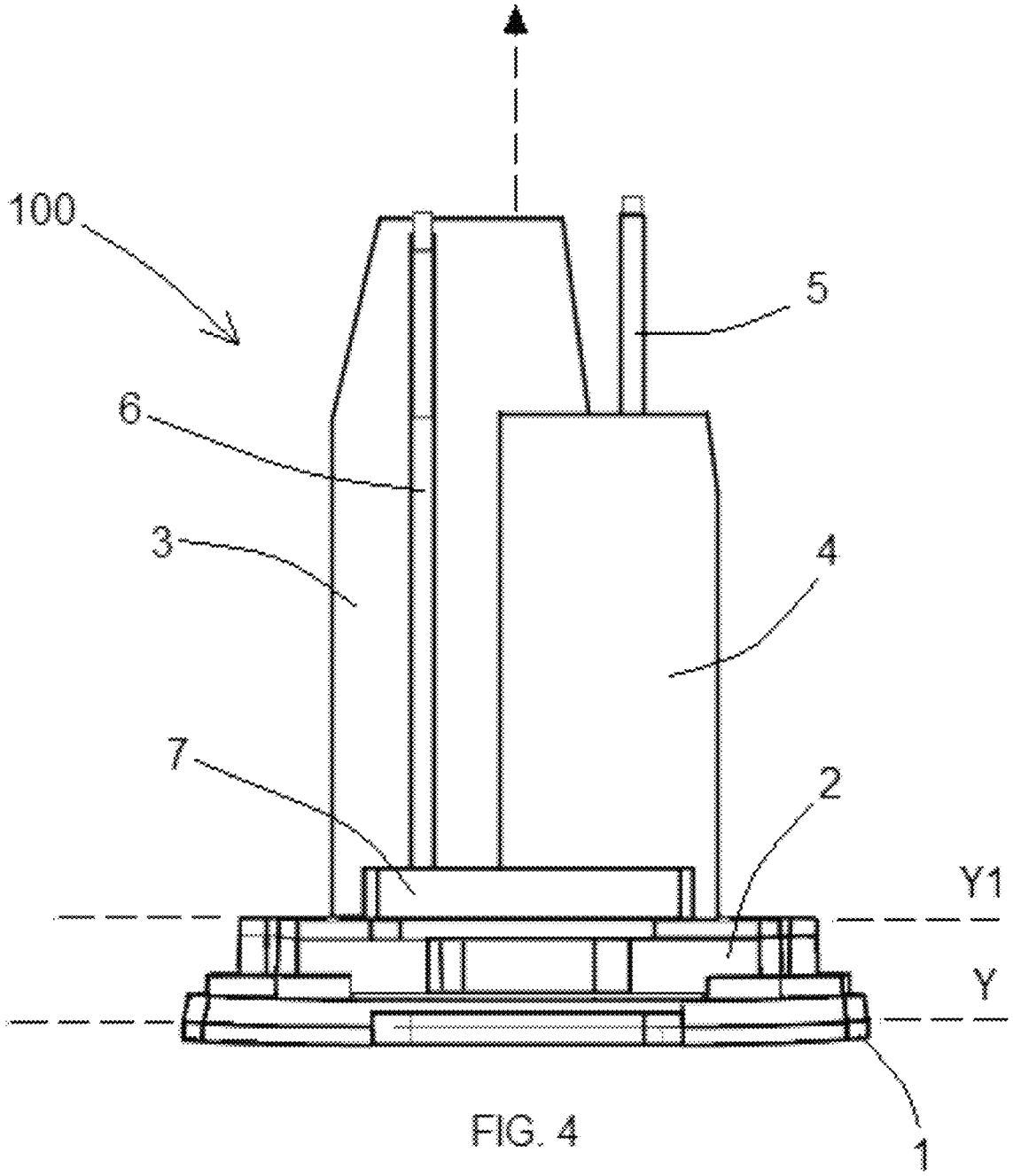
FIG. 4 is a front view of the antenna module of FIG. 1.

With reference to FIG. 3A, the base (1) has a horizontal plane whereon the longitudinal axis (X) of the base lies.

The median axes (a3, a4) of the first and of the second radiant element intersect the horizontal plane of the base in respective intersection points (P1, P2) shown in FIG. 3A.

According to the invention, the intersection points (P1, P2) are disposed on both sides with respect to the longitudinal axis (X) of the base and are spaced by distances (d1, d2) from the longitudinal axis (X) of the base.

Moreover, projection axes (J1, J2) pass by the intersection points (P1, P2) in orthogonal direction relative to the longitudinal axis (X), intersecting the longitudinal axis (X) at different heights (Q1, Q2) of the longitudinal axis.

Therefore, the first radiant element (3) and the second radiant element (4) are misaligned with respect to the longitudinal axis (X) of the base, i.e. they are disposed asymmetrically with respect to the longitudinal axis (X) of the base.

With reference to the figures, the first radiant element (3) is nearer to a left lateral edge (22) of the main board and the second radiant element (4) is nearer to a right lateral edge (23) of the main board.

As mentioned previously, the two radiant elements (3, 4) are offset with respect to the longitudinal axis (X) of the base by the distances (d1, d2). By varying the distances (d1, d2), it is possible to vary the uncoupling between the two antennas composed of the radiant elements (3, 4), in such a way to set the correct distances to maximize the uncoupling, as well as the homogeneity and the isotropicity of the radiation diagrams.

It must be considered that, because of the volume of the cover (200), the maximum distances (d1, d2) of the first and of the second radiant element from the longitudinal axis (X) can be approximately ⅓-¼ of the width (W) of the base (1).

In the configuration shown in FIG. 3, the first and the second radiant element (3, 4) are arranged in a transverse direction with respect to the main board (2) and the antenna module also comprises a second pair of radiant elements comprising a third radiant element (5) and a fourth radiant element (6) that constitute two additional antennas that are physically separate and implement distinct functions, which are in turn separate and distinct from the functions implemented by the first and the second radiant element (3, 4).

The third and the fourth radiant element (5, 6) are arranged vertically in longitudinal direction on the main board (2), i.e. the surfaces of the radiant elements are parallel to the longitudinal axis (X) of the base.

The third radiant element (5) and the fourth radiant element (6) are misaligned with respect to the longitudinal axis (X) of the base. Otherwise said, the third radiant element (5) and the fourth radiant element (6) are disposed in parallel position and are spaced from the longitudinal axis (X) of the base.

Moreover, the third radiant element (5) and the fourth radiant element (6) are misaligned with respect to the longitudinal axis (X) of the base, i.e. they are disposed asymmetrically with respect to the longitudinal axis (X) of the base.

The third and the fourth radiant element (5, 6) have respective median axes (a5, a6). The median axes (a5, a6) of the third and of the fourth radiant element intersect the horizontal plane of the base (1) in respective intersection points (P3, P4) shown in FIG. 3A.

With reference to FIG. 3A, the intersection points (P3, P4) of the median axes (a5, a6) of the third and of the fourth radiant element are disposed on both sides with respect to the longitudinal axis (X) of the base and are spaced by respective distances (d3, d4) from the longitudinal axis (X) of the base.

Moreover, projection axes (J3, J4) orthogonal to the longitudinal axis (X) pass by the intersection points (P3, P4), intersecting the longitudinal axis (X) at different heights (Q3, Q4) of the longitudinal axis.

Also in this case, the maximum distances (d3, d4) of the first and of the second radiant element from the longitudinal axis (X) can be approximately ⅓-¼ of the width (W) of the base (1).

By varying the distances (d3, d4) of the intersection points (P3, P4) of the median axes of the third and of the fourth radiant element with respect to the longitudinal axis (X) of the base, it is possible to vary the uncoupling between the two antennas composed of the third and fourth radiant elements, in such a way to set the correct distances to maximize the uncoupling, as well as the homogeneity and the isotropicity of the radiation diagrams.

Furthermore, if the antenna module (100) comprises a first pair of radiant elements (composed of the first and of the second radiant element (3, 4)) in misaligned position, and a second pair of radiant elements (composed of the third and of the fourth radiant element (5, 6)) in misaligned position, by varying the misalignment of an individual radiant element it is possible to optimize the radiation diagram of that individual radiant element.

Moreover, by varying the heights (Q1, Q2, Q3, Q4) of each radiant element (3, 4, 5, 6) along the longitudinal axis (X) it is possible to optimize the radiation diagram of that radiant element. Since the cover (202) has a tapered front part (201), the heights (Q1, Q2, Q3, Q4) of each radiant element (3, 4, 5, 6) along the longitudinal axis (X) cannot result in having the fourth radiant element (6) at the front end of the base (1). Whereas the height (Q1) of the first radiant element (3) is near the rear end of the base, the height (Q4) of the fourth radiant element (6) is near the center line (Y) of the base.

With reference to FIGS. 1 and 3, the third radiant element (5) is nearer to a right lateral edge (23) of the main board and the fourth radiant element (6) is nearer to a left lateral edge (22) of the main board.

Advantageously, the first radiant element (3) is near the rear end (20) of the main board. The second radiant element (4) is disposed near the transverse axis (Y1) coinciding with the center line of the main board. The third radiant element (5) is disposed between the first and the second radiant element (3, 4). The fourth radiant element (6) is disposed in the front relative to the second radiant element (4), leaving a front portion of the base (1) free.

Although FIG. 3 shows an antenna module comprising four radiant elements (3, 4, 5, 6) that extend vertically, the antenna module may comprise more than four radiant elements that extend vertically.

Moreover, at least one of the third and the fourth radiant element (5, 6) can be disposed in oblique direction, i.e. the plane of the radiant element is oblique relative to the longitudinal axis (X) of the base.

Figure 2:
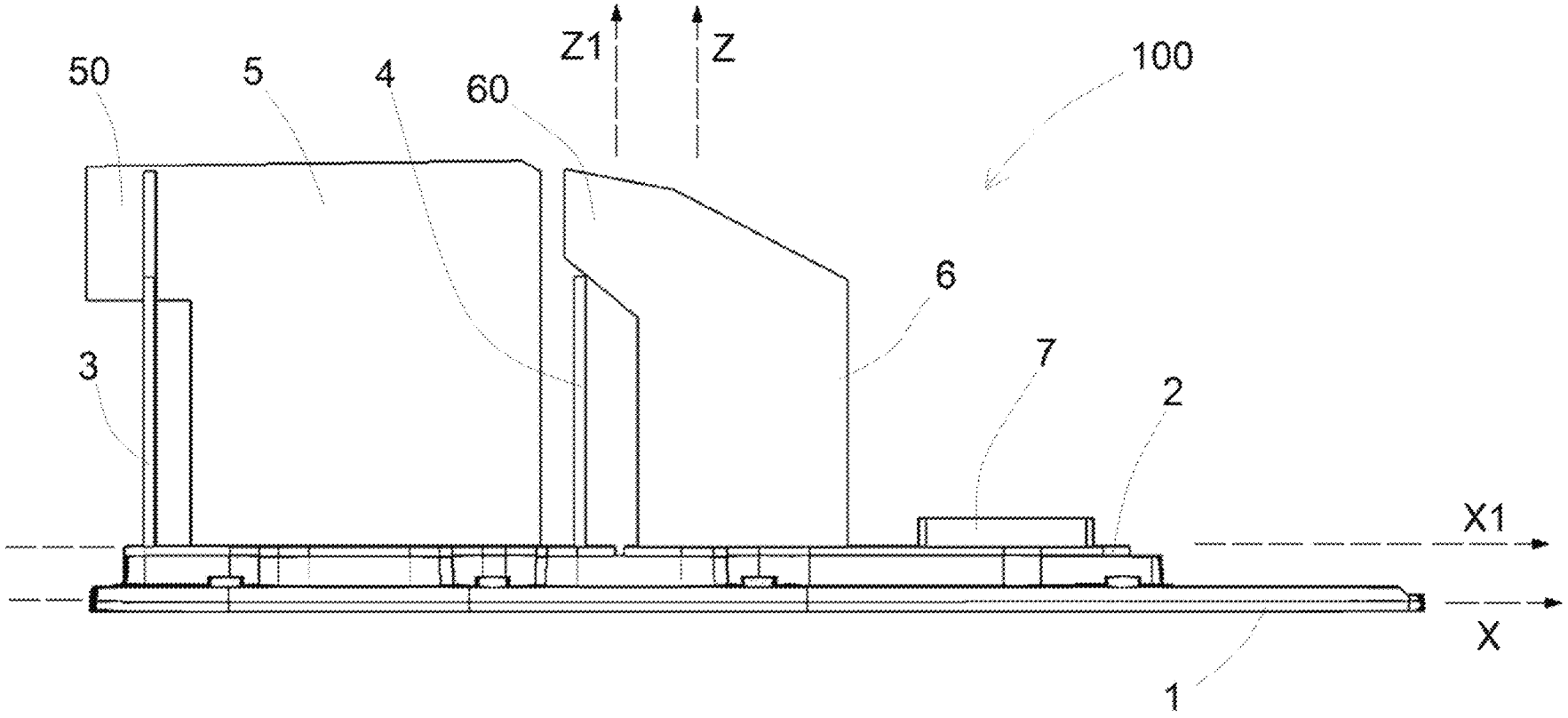
FIG. 2 is a side view of the antenna module of FIG. 1.

With reference to FIGS. 1 and 2, the third radiant element (5) is a PCB provided with an upper portion (50) that protrudes from the rear and does not interfere with the first radiant element (3) because the first radiant element (3) is near the right lateral edge (22) of the main board, and the third radiant element (5) is near the left lateral side (23) of the main PCB.

Similarly, the fourth radiant element (6) is a PCB provided with an upper portion (60) that protrudes from the rear and does not interfere with the second radiant element (4) because the second radiant element (4) is near the left lateral edge (23) of the main board, and the fourth radiant element (6) is near the right lateral side (23) of the main board.

It must be noted that four radiant elements (3, 4, 5, 6) do not touch and do not intersect.

The fourth radiant element (6) does not extend in a front part of the main board (2). In fact, an integrated circuit (7) with square, circular or rectangular shape can be arranged in the front of the main board (2), occupying a limited space in height and implementing a fifth patch antenna.

For illustrative purposes:

the first radiant element (3) implements a first antenna for mobile telephony (LTE or 5G), the second radiant element (4) implements a second antenna for mobile telephony (LTE or 5G), the third radiant element (5) implements an AM/FM antenna, the fourth radiant element (6) implements a DAB antenna, and the integrated circuit (7) implements a GNSS/GPS antenna.

The telephony antennas implemented by the first and the second radiant element (3, 4) can use the LTE (Long Term Evolution) standard used by Fourth Generation (4G) cellular telephones or another standard for Fifth Generation (5G) or later generation cellular telephones.

The AM/FM antenna implemented by the third radiant element (5) is a radio antenna with amplitude/frequency modulation.

The DAB antenna implemented by the fourth radiant element (6) is a radio antenna that uses the DAB (Digital Audio Broadcasting) standard, which is a digital audio broadcasting standard that allows for a sound transmission of radio programs with better quality.

The GNSS/GPS antenna, implemented by the integrated circuit (7), is an antenna for receiving signals from a global navigation satellite system (GNSS/GPS), which is a geo-radiolocation and earth navigation system using a network of orbiting artificial satellites and pseudolites.

Figure 5:
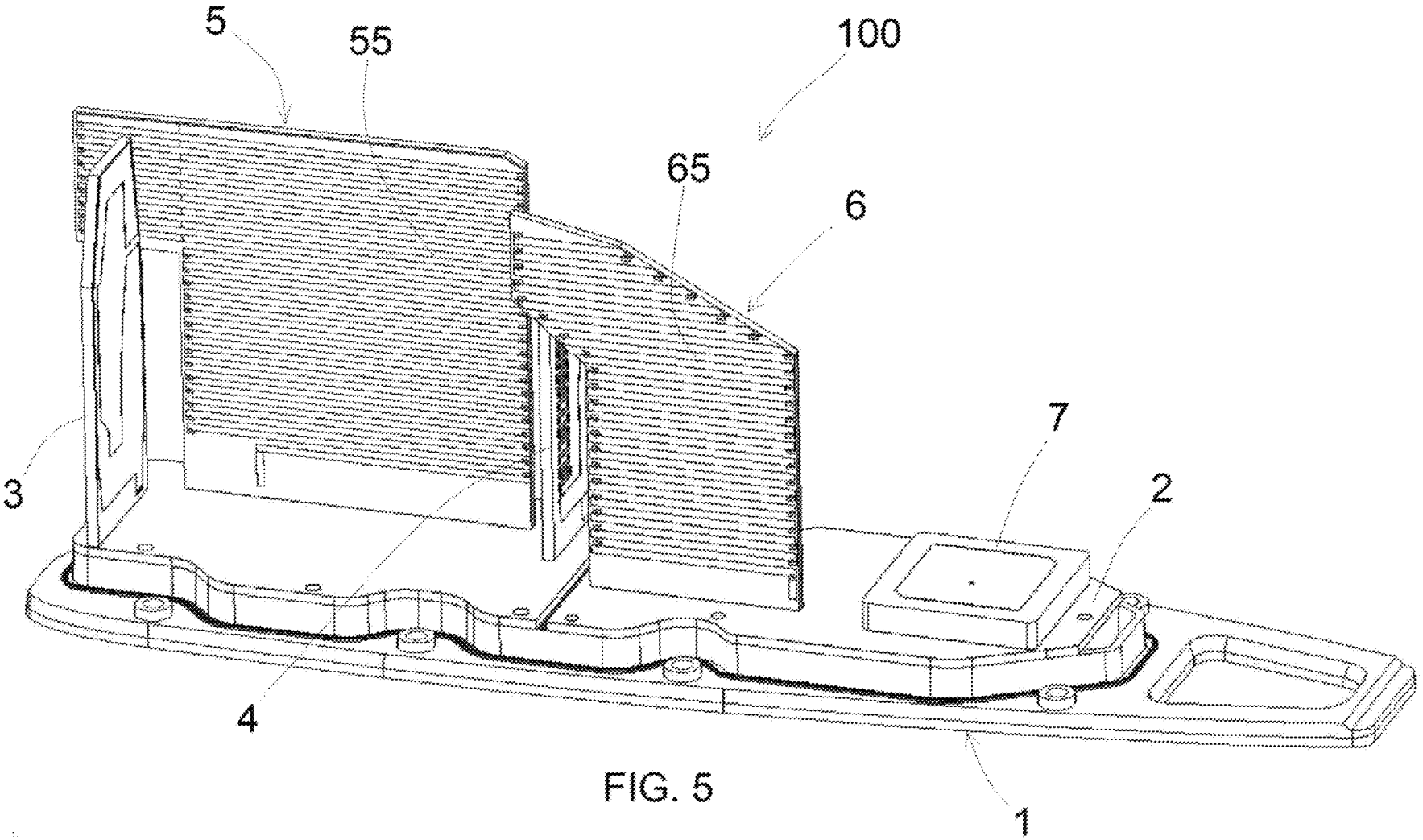
FIG. 5 is the same view as FIG. 1, which shows radiant elements composed of PCBs with conductive tracks.

With reference to FIG. 5, the third and the fourth radiant element (3, 4) are PCBs that contain respective inductances generated by a single spiral coil (55, 66) obtained with tracks on the PCB.

Figure 6:
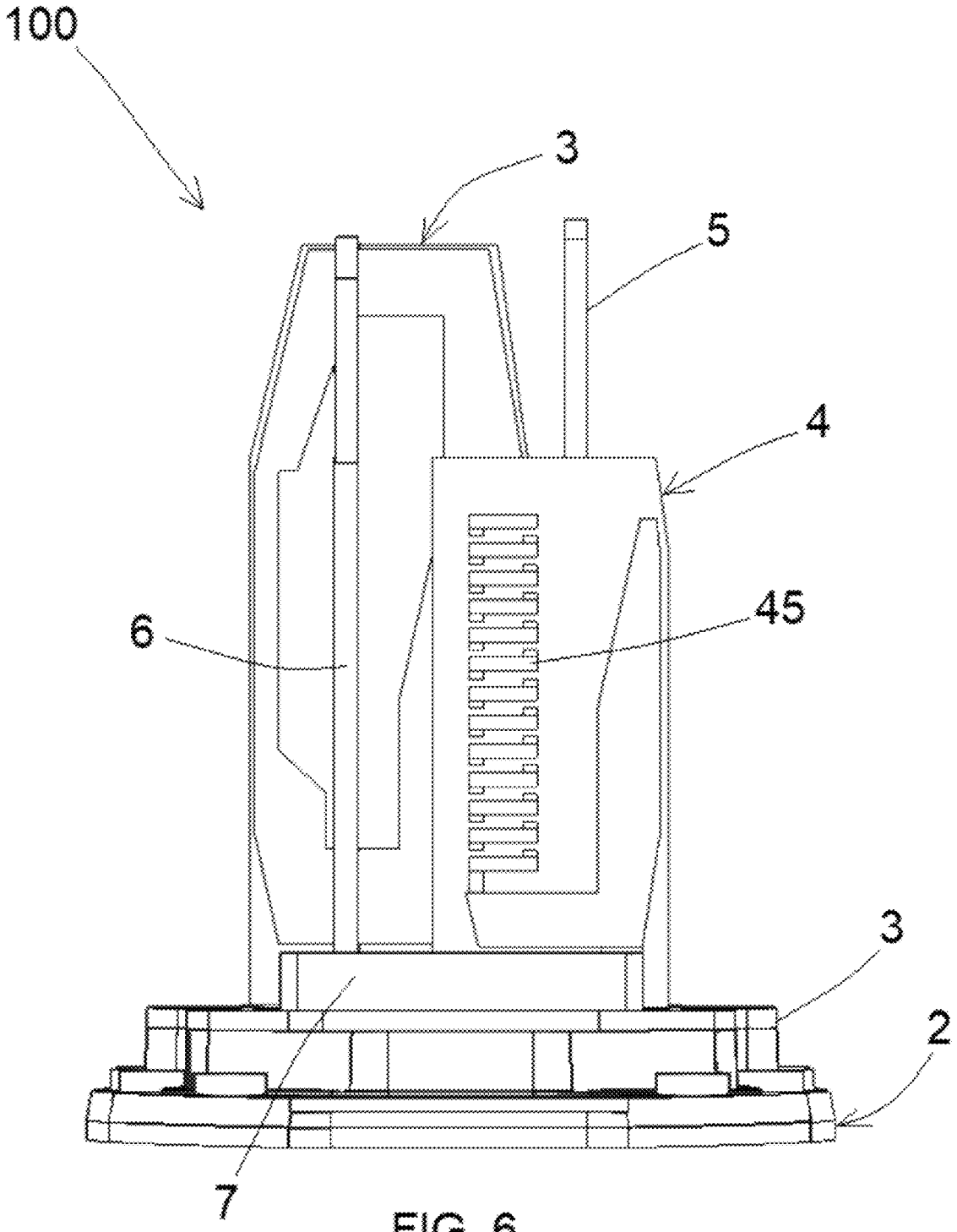
FIG. 6 is the same view as FIG. 4, which shows the tracks on the PCBs of the radiant elements.

With reference to FIG. 6, the first radiant element (3) contains branches of two monopoles. A monopole is longer than the other monopole and is partially folded. Said monopoles are necessary to realize a frequency behavior suitable for covering the operation of two groups of bands assigned to the mobile telephony. The longer monopole covers a lower frequency band and the shorter monopole covers a higher frequency band.

The second radiant element (4) is composed of a PCB that contains a monopole and an inductance generated with a single spiral coil (45) obtained with tracks on the PCBs.

Figure 8:
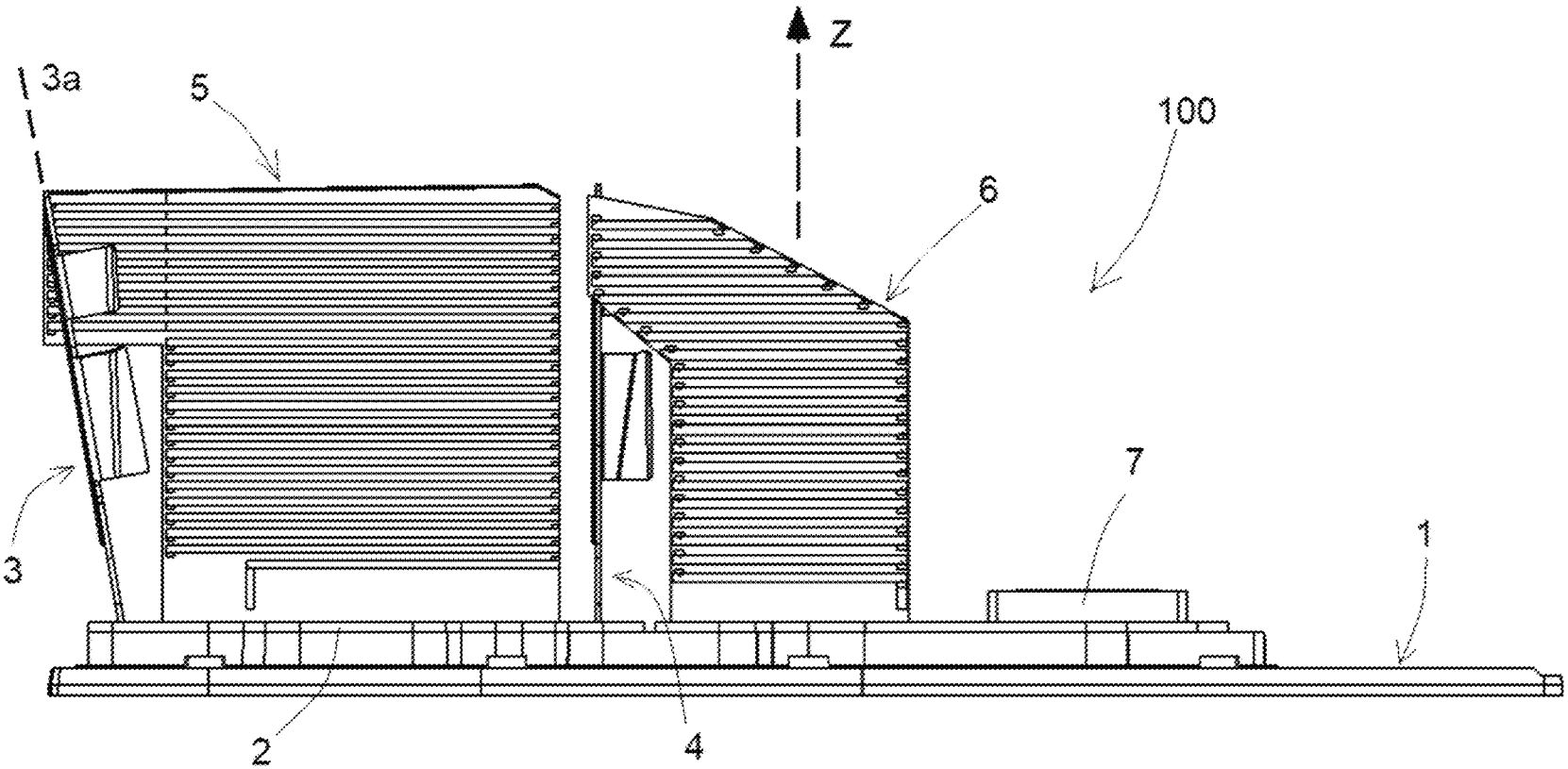
FIG. 8 is a side view of the antenna module of FIG. 7.
Figure 9:
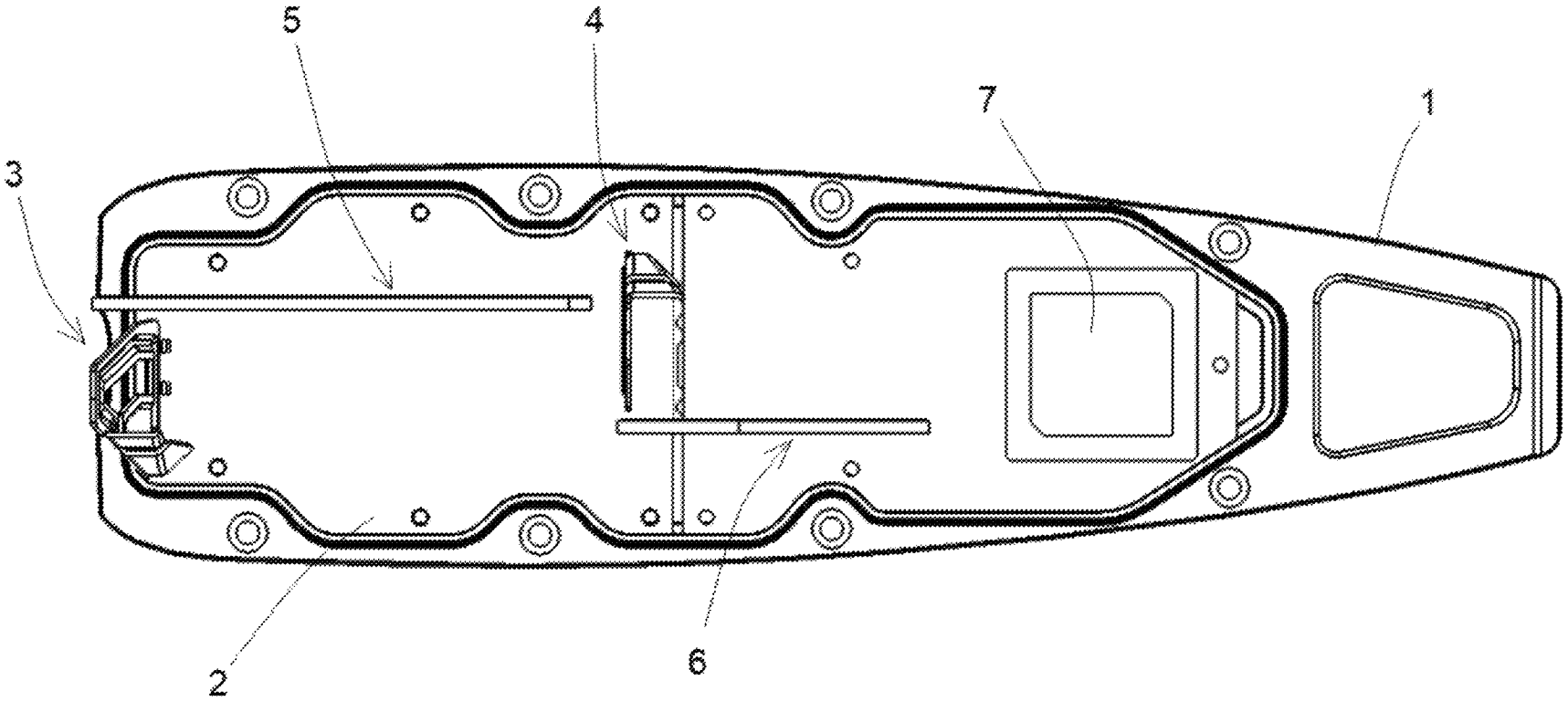
FIG. 9 is a top view of the antenna module of FIG. 7.

With reference to FIGS. 7-9, the first and the second radiant element (3, 4) are composed of a conductive track made of suitably shaped sheet metal. The conductive plate has a C-shape when seen in a front view with folded edges (35).

In any case, the conductive plate of each radiant element has a substantially planar geometry and mostly extends in vertical direction with respect to the base (1).

In particular, the first radiant element (3) has a median axis (3*a*) that is inclined in the rear with respect to the vertical axis (Z) of the base of an angle of approximately 10°-40°.

The antenna module (100) of the invention has been conceived for an elongated narrow base (1), where the ratio of the length (L) to the width (W) is higher than 3. Moreover, it must be considered that the width (W) of the base is generally lower than 60 mm. This results in a proximity of the radiant elements (3, 4, 5, 6) that generates interference if said radiant elements are not disposed asymmetrically.

Moreover, it must be considered that the cover (200) has a tapered front portion (202). Therefore, the radiant elements (3, 4, 5, 6) with a certain height must be disposed in the rear in order to prevent them from interfering with the cover. Instead, the integrated circuit (7) that implements a patch antenna can be disposed in the front.

We claim:

1. An antenna module for a vehicle comprising:

a base suitable for being fixed to a part of the vehicle body along a horizontal plane; said base has an elongated shape with a length and a width, wherein the length is more than three times higher than the width; said base has a longitudinal axis that extends along a longitudinal center line of the base, and a vertical axis that extends orthogonally to the horizontal plane of the base;

a main board disposed horizontally on the base; said main board has an elongated shape with a length lower than the length of the base and a width lower than the width of the base; wherein the length of the main board is twice and a half times higher than the width of the main board;

a first pair of radiant elements comprising a first radiant element and a second radiant element; and a second pair of radiant elements comprising a third radiant element and a fourth radiant element;

wherein the radiant elements protrude in upper position from the main board along a direction of the vertical axis; each radiant element implementing the functions of an independent antenna, without cooperating with the other radiant elements;

the radiant elements have respective median axes that extend in the direction of the vertical axis and intersect the horizontal plane of the base in respective intersection points;

the intersection points of the median axes of the first and of the second radiant element are disposed on both sides with respect to the longitudinal axis of the base and are spaced by distances from the longitudinal axis of the base;

the intersection points of the median axes of the third and fourth radiant element are disposed on both sides with respect to the longitudinal axis of the base and are spaced by distances from the longitudinal axis of the base;

projection axes orthogonal to the longitudinal axis pass by said intersection points of the median axes of the radiant elements, intersecting the longitudinal axis at different heights of the longitudinal axis.

2. The antenna module of claim 1, wherein said first and second radiant element have a substantially planar geometry and are disposed in transverse direction, i.e. with orthogonal planes relative to the longitudinal axis.

3. The antenna module of claim 1, wherein the first radiant element is disposed near a rear end of the main board and the second radiant element is disposed near a transverse axis that coincides with a median axis of the main board.

4. The antenna module of claim 3, wherein said first radiant element is disposed with inclined direction in the rear, i.e. with the median axis of the radiant element inclined in the rear relative to the vertical axis orthogonal to the horizontal plane of the base.

5. The antenna module according to claim 1, wherein said third and fourth radiant element have a planar geometry and are disposed in longitudinal direction, i.e. with the planes of the third radiant element parallel to the longitudinal axis of the base.

6. The antenna module according to claim 1, wherein said third and fourth radiant element have a planar geometry, and at least one of said third and fourth radiant element is disposed in oblique direction, i.e. with a plane of the radiant element in oblique direction relative to the longitudinal axis of the base.

7. The antenna module of claim 6, wherein the first radiant element is disposed near a rear end of the main board; the second radiant element is disposed near a transverse axis that coincides with a median axis of the main board; the third radiant element is disposed between the first and the second radiant element and the fourth radiant element is disposed in front of the second radiant element.

8. The antenna module of claim 7, wherein the third radiant element is a PCB with an upper portion that protrudes in the rear and does not touch the first radiant element.

9. The antenna module of claim 7, wherein the fourth radiant element is a PCB with an upper portion that protrudes in the rear and does not touch the second radiant element.

10. The antenna module of claim 6, wherein the third radiant element implements an AM/FM antenna and the fourth radiant element implements a DAB antenna.

11. The antenna module of claim 6, wherein said radiant elements are not in contact and do not intersect.

12. The antenna module of claim 1, further comprising an integrated circuit that implements a GNSS/GPS antenna and is disposed in a front part of the main board with horizontal direction.

13. The antenna module of claim 1, wherein the first radiant element implements a first antenna for LTE or 5G telephony, and the second radiant element implements a second antenna for LTE or 5G telephony.

* * * * *